US005284371A

United States Patent [19]

Richardson et al.

[11] Patent Number: 5,284,371

[45] Date of Patent: Feb. 8, 1994

[54] SLIDING DOOR LOCK

[75] Inventors: Richard J. Richardson, Simi Valley; Charles E. Crown, San Fernando, both of Calif.

[73] Assignee: Anthony's Manufacturing Company, Inc., San Fernando, Calif.

[21] Appl. No.: 988,301

[22] Filed: Oct. 9, 1992

[51] Int. Cl.[5] ..... E05C 1/04

[52] U.S. Cl. ..... 292/149; 292/DIG. 46

[58] Field of Search ..... 292/149, 175, 302, 206, 292/DIG. 46, DIG. 47

[56] References Cited

U.S. PATENT DOCUMENTS

| | | | |
|---|---|---|---|
| 692,047 | 1/1902 | Bronson | 292/149 X |
| 2,431,178 | 11/1947 | Keane | 292/149 |
| 3,347,585 | 10/1967 | Chmura | 292/294 |
| 3,944,266 | 3/1976 | Weaver | 292/149 X |
| 3,975,041 | 8/1976 | Edison | 292/258 |
| 4,066,284 | 1/1978 | Ikemura | 292/62 |
| 4,475,313 | 10/1984 | Governale | 49/370 |
| 4,514,996 | 5/1985 | Sjogren | 70/100 |
| 4,971,374 | 11/1990 | Lovell et al. | 292/DIG. 46 X |
| 5,127,685 | 7/1992 | Dallaire et al. | 292/175 |

*Primary Examiner*—Richard E. Moore

*Attorney, Agent, or Firm*—Poms, Smith, Lande & Rose

[57] ABSTRACT

A sliding door lock having a latch plate, which slidably engages a channel in one leg of a corner piece. The corner piece is mounted in a door frame. A stud is attached to the slider plate so that a person may grasp the stud and slide the plate up and down. The stud has internal threads. A small screw is threaded into the internal threads of the stud. The sliding door lock is used by grasping the stud, which extends through an elongated slot in the door frame, and using the stud to move the latch plate upward so that it extends past the top of the door frame. The small screw is then used to hold the latch plate in an upward position. A tool is used to thread the small screw past the end of the stud so that the end of the small screw is in frictional contact with the corner piece, thus holding the latch plate in the upward position. When the latch plate is locked in the upward position, the door cannot be slid open because the upper end of the plate will come into contact with a block positioned above the door frame and mounted on a supporting structure surrounding the door frame. The latch plate may also be used in conjunction with other blocks for the purpose of holding the sliding door open.

17 Claims, 2 Drawing Sheets

SLIDING DOOR LOCK

BACKGROUND OF THE INVENTION

The present invention relates generally to door locks, and more particularly to a sliding door lock which may be used to lock a sliding door and to hold the door open.

In the past, a variety of different locks have been used to lock a sliding door or window. For example, U.S. Pat. No. 4,514,996, issued to Sjogren on May 7, 1985, discloses a sliding door lock mounted to the end of a sliding door frame. A handle attached to a bolt is used to move the bolt upward until it engages one of several apertures in a door frame casement. The bolt may be locked in an upward position using a barrel lock, thus preventing the door frame from moving.

U.S. Pat. No. 4,475,313, issued to Governale on Oct. 9, 1984, describes two different locking devices used for sliding doors. One device uses knobs at the top and bottom of a door frame to move sliding bolts into openings at top and bottom portions of a surrounding frame sill structure. Slots in the door frame allow vertical movement of the knobs, which are locked in place by compression springs. The second device uses a lever operated swinging latch bolt, pivotally mounted in a bolt housing mounted on a door frame. An extension of the bolt removably engages a slot in an adjacent door.

A latch used for windows or doors is disclosed in U.S. Pat. No. 4,066,284, issued to Ikemura on Jan. 3, 1978. A latch bolt is slidably mounted in a housing, which may be attached to a window or sliding door. A handle is used to move the bolt longitudinally along the length of the housing until the end of the bolt engages a recess in the surrounding door or window structure. The handle removably engages one of the channels in a plate member of the housing. A spring biases the handle into a channel, keeping the end of the bolt in the recess.

Another lock used for locking sliding windows or doors is disclosed in U.S. Pat. No. 3,975,041, issued to Edison on Aug. 17, 1976. A screw is used to clamp members to one of the legs of a channel guide on which a window or door is slidably mounted. The members are in contact with the frame of the window or door, effectively preventing sliding movement of the window or door.

U.S. Pat. No. 3,944,266, issued to Weaver on Mar. 16, 1976, discloses a locking latch for sliding doors. The latch has a housing which is attached to the outside of a door frame. A plate is free to move vertically along the length of the housing. The plate has two upward extensions at its upper end. A thumb screw is threaded into a threaded aperture in the plate. A slot in the housing allows a person to grasp the screw and move the plate up and down. A sliding door may be locked in place by moving the extensions of the plate upward, using the screw, until the extensions engage apertures in a surrounding structure.

U.S. Pat. No. 3,347,585, issued to Chmura on Oct. 17, 1967, discloses a sliding window lock using an elongated member EE, having a number of notches along the length thereof. Member EE is mounted on a sliding window. A U-shaped locking member LE may be attached to elongated member EE at different locations along the length of the member EE by selectively using different notches. A lock screw is used to attach members EE and LE together. The locking member LE limits sliding movement of an adjacent window.

SUMMARY OF THE INVENTION

It is an object of this invention to provide a sliding door lock that may be used to lock a sliding door and to hold the sliding door open.

It is another object of this invention to provide a sliding door lock that is mounted inside a door frame.

It is still another object of this invention to provide a sliding door lock that is easy to install and to remove.

It is still another object of this invention to provide a sliding door lock that is economical to manufacture and easy to use.

These and other objects and advantages are attained by a sliding door lock having a latch plate, which slidably engages a channel in one leg of a corner piece. The corner piece is mounted in a door frame. A stud is attached to the slider plate so that a person may grasp the stud and slide the plate up and down. The stud has internal threads. A small screw is threaded into the internal threads of the stud.

The sliding door lock is used by grasping the stud, which extends through an elongated slot in the door frame, and using the stud to move the latch plate upward so that it extends past the top of the door frame. Upward movement of the latch plate is stopped when the bottom end of an elongated slot in the plate contacts a screw used to fasten the corner piece to the door frame. The small screw is then used to hold the latch plate in an upward position. A tool is used to thread the small screw past the end of the stud so that the end of the small screw is in frictional contact with the corner piece, thus holding the latch plate in the upward position.

When the latch plate is locked in the upward position, the door cannot be slid open because the upper end of the plate will come into contact with a block positioned above the door frame and mounted on a supporting structure surrounding the door frame. The latch plate may also be used in conjunction with other blocks for the purpose of holding the sliding door open. The sliding door may be unlocked by using the tool to thread the end of the small screw away from (or out of frictional contact with) the corner piece, so that the stud may be grasped and the latch plate may be moved downward.

The various features of the present invention will be best understood together with further objects and advantages by reference to the following description of the preferred embodiment when taken in conjunction with the accompanying drawings.

DESCRIPTION OF THE PREFERRED EMBODIMENT

The following specification taken in conjunction with the drawings sets forth the preferred embodiment of the present invention in such a manner that any person skilled in the art can make and use the invention. The embodiment of the invention disclosed herein is the best mode contemplated by the inventors for carrying out their invention in a commercial environment, although it should be understood that various modifications can be accomplished within the parameters of the present invention.

Figure 1:
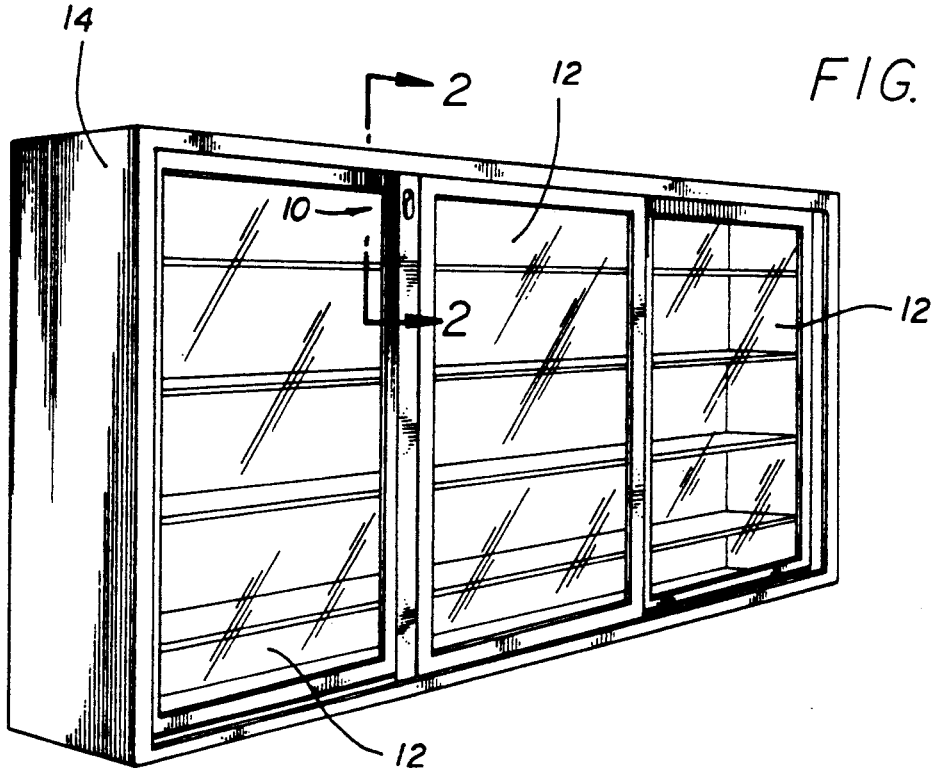
FIG. 1 is a perspective view of a display case having sliding doors, showing a sliding door lock of the present invention mounted on one of the doors.

FIG. 1 shows a sliding door lock 10 of the present invention mounted on a sliding door 12 of a display case 14. The sliding door lock 10 may be used for the sliding doors of a refrigerated display case used in supermarkets, or other retail establishments. However, the sliding door lock 10 may be used for any type of sliding doors such as sliding doors used in a residence. Also, lock 10 may be used for sliding windows.

Figure 2:
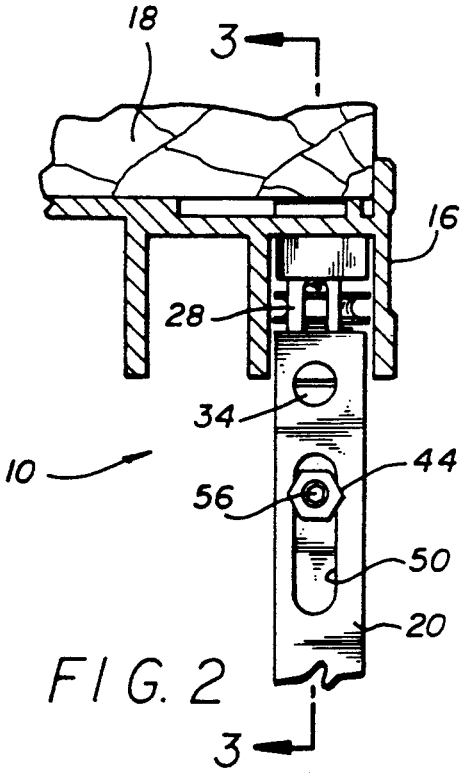
FIG. 2 is a cross-sectional view taken in the direction of arrows 2—2 of FIG. 1, showing a latch plate of the sliding door lock locked in an upward position.
Figure 3:
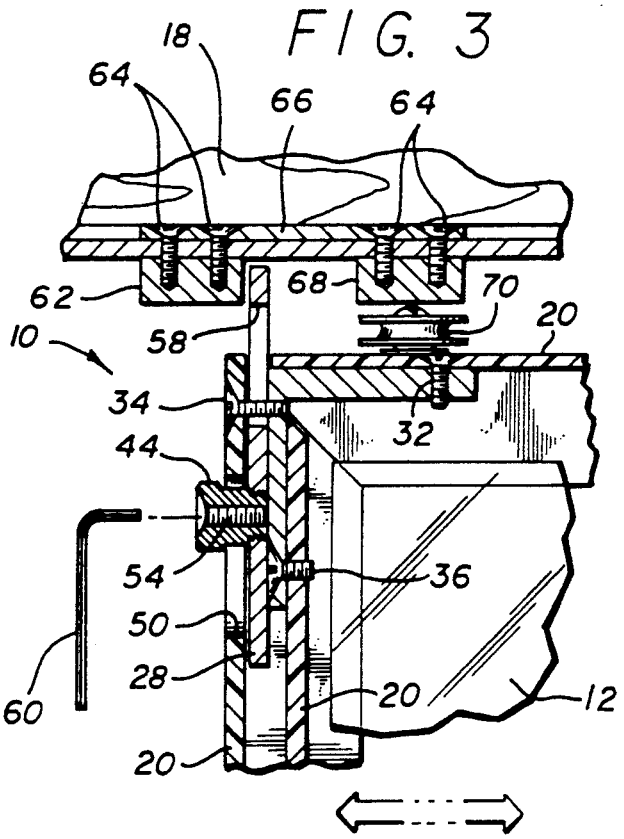
FIG. 3 is a cross-sectional view taken in the direction of arrows 3—3 of FIG. 2, showing how the sliding door lock is mounted inside a door frame.

As shown in FIG. 2, the sliding door 12 may be mounted in a channel support 16 attached to a supporting structure 18 of the display case 14. The sliding door lock 10 is mounted inside a door frame 20 of the sliding door 12, as shown in FIG. 3. As a result, lock 10 fits conveniently inside the door frame 20, and does not require a housing typically used for prior art locking devices. Such housings are usually attached to the outside of door frames, and present a bulky, unattractive appearance for sliding doors.

The sliding door lock 10 has a corner piece 22 with two legs 24 and 26. A latch plate 28 slidably engages a channel 30 in leg 24 of the corner piece 22 (see FIG. 4). Screws 32 through 36 engage threaded apertures 38 through 42, respectively, in the corner piece 22, and are used to attach the corner piece 22 to the door frame 20. Aperture 42 is preferably countersinked. Corresponding threaded apertures are used in the door frame 20 for the screws 32 through 36. As shown in FIG. 3, the apertures at the outside of the door frame 20 are preferably countersinked and flat screw heads are preferably used for screws 32 through 36 to provide flat, flush surfaces.

A stud 44 is attached to the latch plate 28 by threaded end 46, which engages internal threads 47 of aperture 48 in the plate 28. However, the stud 44 may be press-fitted, or otherwise attached to the plate 28. The stud 44 extends through an elongated slot 50 in the door frame 20. As a result, a person may grasp the stud 44 and move the latch plate 28 up and down.

The stud 44 has internal threads 52. A small screw 54 is threaded into the internal threads 52 of the stud 44. The screw 54 has an engaging recess 56, such as a hex-shaped recess, at one end. However, any shaped recess may be used.

The latch plate 28 has an elongated slot 58 in the upper portion thereof. Screw 34 passes through slot 58 as shown in FIG. 3. The sliding door lock 10 is used by grasping the stud 44, and using the stud 44 to move latch plate 28 upward so that it extends past the top of the door frame 20. Upward movement of the latch plate 28 is stopped when the bottom end of elongated slot 58 in plate 28 comes into contact with screw 34. The small screw 54 is then used to hold the latch plate 28 in an upward position. This is accomplished by inserting a tool 60 into recess 56 of screw 54, and threading the screw 54 past the threaded end 46 of the stud 44 so that the end of the screw 54 is in frictional contact with the corner piece 22, thus holding the latch plate 28 in the upward position.

When the latch plate 28 is locked in the upward position, the door 12 cannot be slid open (moved to the left as shown in FIG. 3) because the upper end of plate 28 will come into contact with a block 62 positioned above the door 12, and attached to the supporting structure 18 by screws 64. A plate 66 may be used as shown in FIG. 3, if desired. The door 12 shown in FIG. 3 is opened by sliding the door 12 to the left. The supporting structure 18 prevents the door 12 from being slid to the right when the door 12 is closed, or positioned as shown in FIG. 3. As a result, the lock 10 keeps the sliding door 12 from being opened. The door 12 may be unlocked by using the tool 60 to thread the screw 54 to the left (see FIG. 3), or so that the end of the screw 54 is no longer in frictional contact with the corner piece 22. Plate 28 may then be lowered.

Another block 68 may be positioned over the door 12 as shown in FIG. 3, so that the block 68 is located above a pulley 70 used for the door 12. When the door 12 is locked as shown in FIG. 3, block 68 prevents the door 12 from being lifted out of its bottom track, or bottom channel support 16, because lifting of the door 12 will cause the pulley 70 to come into contact with block 68.

The sliding door lock 10 may also be used to hold the door 12 open. This may be accomplished by attaching additional blocks (not shown) to the supporting structure 18, above the door 12 and to the left of the door 12 (see FIG. 3). Therefore, when the door 12 is slid to the left, latch plate 28 may be locked in an upward position, using lock 10, and positioned to the left of one of the additional blocks, thus preventing the door 12 from closing or sliding to the right. As a result, the door 12 may be held open at different positions by selectively locating the additional blocks.

Figure 4:
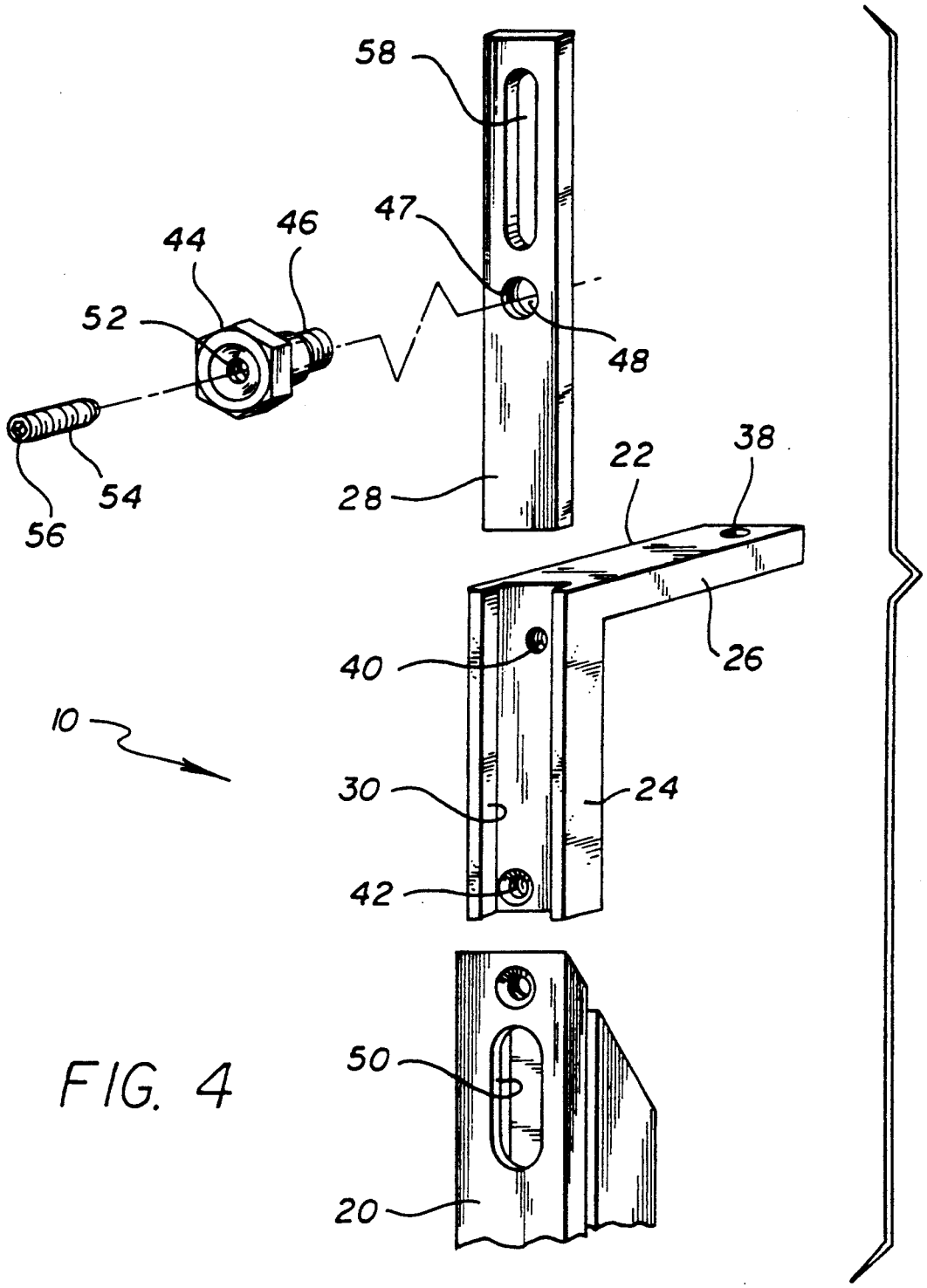
FIG. 4 is an exploded perspective view of the sliding door lock and a portion of the door frame.

Downward movement of the stud 44 may be limited by the bottom end of slot 50, or by the top end of slot 58 coming into contact with screw 34. Also, if desired, upward movement of the latch plate 28 may be restricted by the top end of the plate 28 coming into contact with the supporting structure 18. In addition, instead of using screw 54 to hold plate 28 in an upward position, the stud 44 may be screwed into internal threads 47 of aperture 48 in plate 28 so that the end of the stud 44 is in frictional contact with the corner piece 22. As such, screw 54 may be eliminated, if desired. Also, note that the door frame 20, at the corner of the door 12 where the lock 10 is mounted, consists of horizontal and vertical portions (only the vertical portion is shown in FIG. 4). This facilitates mounting the lock 10 inside the frame 20. As mentioned above, the recess 56 may have any shape that matches tool 60. For example, recess 56 may be an aperture having indentations at the bottom of the aperture. The matching tool 60 would then have extensions at the end thereof that fit into the indentations of the aperture. Any special tool may be fabricated for use with screw 54. Finally, bolts or other types of fasteners may be used instead of screws.

The above description discloses the preferred embodiment of the present invention. However, persons of ordinary skill in the art are capable of numerous modifications once taught these principles. Accordingly, it will be understood by those skilled in the art that changes in form and details may be made to the above-described embodiment without departing from the spirit and scope of the invention.

We claim:

1. A locking device for use with a frame slidably mounted in a supporting structure comprising:

a corner piece having two legs mounted inside said frame;

a latch plate slidably engaging one of said legs of said corner piece; and means engaged to said latch plate for releasably holding said latch plate in an upward position.

2. A locking device comprising:

a corner piece having two legs;

a latch plate slidably engaging one of said legs of said corner piece;

means engaged to said latch plate for releasably holding said latch plate in an upward position, said locking device being mounted inside a door frame, said door frame being slidably mounted on a supporting structure; and a block mounted on said supporting structure and positioned above said door frame, said latch plate adapted to contact said block when in said upward position in order to prevent movement of said door frame.

3. The locking device of claim 1 wherein said means for releasably holding said latch plate in an upward position comprises a stud engaged to said latch plate and a screw engaging said stud and adapted to be in frictional contact with said latch plate.

4. The locking device of claim 3 further comprising a tool adapted to engage and apply torque to said screw.

5. The locking device of claim 1 wherein said means for releasably holding said latch plate in an upward position comprises a stud, said latch plate having an aperture with internal threads, said stud engaging said internal threads.

6. A locking device for use with a frame slidably mounted in a supporting structure comprising:

a corner piece mounted inside said frame;

a latch plate slidably engaging said corner piece;

a stud engaging said latch plate; and a screw engaging said stud and adapted to releasably be in frictional contact with said latch plate in order to releasably hold said latch plate in an upward position.

7. The locking device of claim 6 further comprising a block mounted to said supporting structure and positioned above said frame, said latch plate adapted to contact said block when in said upward position in order to prevent movement of said frame.

8. The locking device of claim 7 further comprising a tool adapted to engage and apply torque to said screw.

9. The locking device of claim 8 wherein said frame has an elongated slot therein, said stud extending through said elongated slot.

10. The locking device of claim 9 wherein said corner piece has two legs.

11. The locking device of claim 10 wherein one of said legs of said corner piece has a channel therein, said latch plate slidably engaging said channel.

12. A locking device for use with a frame slidably mounted in a supporting structure comprising:

a corner piece mounted inside said frame;

a latch plate slidably engaging said corner piece, said latch plate having a threaded aperture therein; and a stud engaging said threaded aperture and adapted to releasably be in frictional contact with said latch plate in order to releasably hold said latch plate in an upward position.

13. A locking device for use with a frame slidably mounted in a supporting structure comprising:

a corner piece mounted inside said frame;

a latch plate slidably engaging said corner piece, said latch plate having a threaded aperture therein;

a stud engaging said threaded aperture and adapted to releasably be in frictional contact with said latch plate in order to releasably hold said latch plate in an upward position; and a block mounted to said supporting structure and positioned above said frame, said latch plate adapted to contact said block when in said upward position in order to prevent movement of said frame.

14. The locking device of claim 13 wherein said frame has an elongated slot therein, said stud extending through said elongated slot.

15. The locking device of claim 12 wherein said corner piece has two legs.

16. A locking device for use with a frame slidably mounted in a supporting structure comprising:

a corner piece having two legs mounted inside said frame;

a latch plate slidably engaging said corner piece, said latch plate having a threaded aperture therein, one of said legs of said corner piece has a channel therein, said latch plate slidably engaging said channel; and a stud engaging said threaded aperture and adapted to releasably be in frictional contact with said latch plate in order to releasably hold said latch plate in an upward position.

17. The locking device of claim 16 wherein said legs of said corner piece are perpendicular to each other.

* * * * *